US005282649A

United States Patent [19]

Williams et al.

[11] Patent Number: 5,282,649

[45] Date of Patent: Feb. 1, 1994

[54] COMBINED REPOSITIONAL ADHESIVE SHEETS

[75] Inventors: Howard D. Williams, Andover, Kans.; David J. White, Mifflinburg, Pa.

[73] Assignee: Moore Business Forms, Inc., Grand Island, N.Y.

[21] Appl. No.: 820,376

[22] Filed: Jan. 14, 1992

[51] Int. Cl.[5] ..... B42D 15/00

[52] U.S. Cl. ..... 283/56; 283/62; 283/117; 283/81

[58] Field of Search ..... 283/56, 81, 62, 117

[56] References Cited

U.S. PATENT DOCUMENTS

| | | | |
|---|---|---|---|
| 4,767,654 | 8/1988 | Riggsbee | 283/101 X |
| 4,951,969 | 8/1990 | Epstein et al. | 283/101 X |
| 5,007,663 | 4/1991 | Moran | 283/101 X |
| 5,129 682 | 7/1992 | Ashby | 283/81 |

*Primary Examiner*—Paul A. Bell

*Attorney, Agent, or Firm*—Nixon & Vanderhye

[57] ABSTRACT

A business form is provided ideally suited for use by an organization that delivers products, and/or which relies heavily on phone orders. A first paper sheet has a face, back, and first size. Indicia is disposed on the face, and a first pattern of repositional adhesive is disposed on the back. A second sheet having a face and a back, and a size much smaller than the first size, has indicia disposed on its face including a phone number, and a second pattern of repositional adhesive is disposed on its back. The second sheet back is readily removably attached to the face of the first sheet by the second pattern of repositional adhesive. The size of the second sheet is such that it will fit on the hand set of a telephone between the ear piece and mouth piece, and the first indicia includes an illustration of how to place the second sheet on a telephone hand set. The form may also comprise a coupon portion. The form is made by applying the second sheets (labels) to a moving web of paper, which is subsequently formed into the first sheets, and which first sheets can be constructed into a pad.

18 Claims, 1 Drawing Sheet

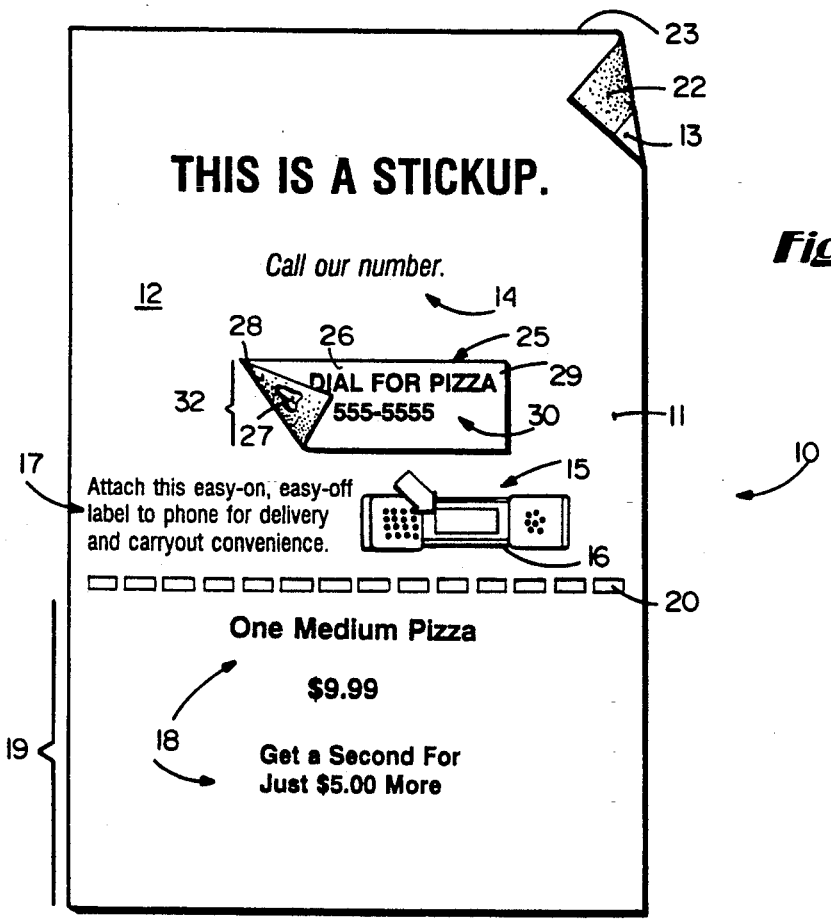
Fig. 1
Fig. 2
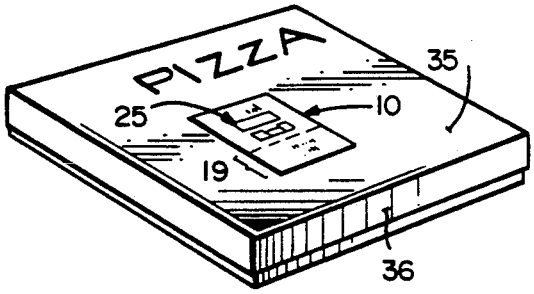
Fig. 3
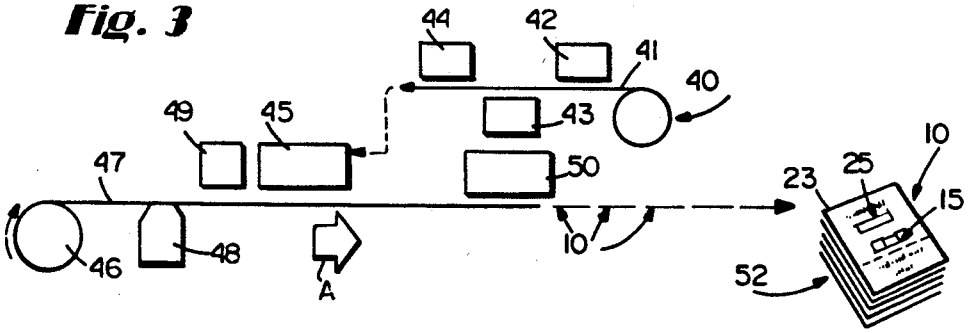

COMBINED REPOSITIONAL ADHESIVE SHEETS

BACKGROUND AND SUMMARY OF THE INVENTION

There are many businesses which offer delivery of products as part of their business, or for which delivery of products is their whole business. These, and other business, especially retail business, often rely on phone orders from individual customers as the primary source of their business. It would be highly desirable if such businesses had an easy way to encourage repeat phone orders.

According to the present invention, a business form, and a method of manufacture of the business form, are provided which encourage repeat telephone orders for businesses as described above. The business form of the invention includes two major components, a first sheet which preferably has a repositional adhesive on its back and indicia on its front and a large size, and a second sheet, typically a label, which has a much smaller size than the first sheet, and repositional adhesive on its back, with indicia on its front including a phone number. The label is placed on the first sheet at a particular location, and the first indicia on the first sheet face preferably includes indicia illustrating use of the label.

The label has a phone number on it, as well as other indication indicating the products offered by calling the phone number, the name of the organization, or the like, and has dimensions such that it will easily fit on a telephone hand set between the ear piece and mouth piece thereof. The first indicia preferably includes an illustration showing how the label is applied to a telephone hand set.

To maximize advertising and to further encourage repeat orders, it is desirable to provide a portion of the first sheet as a coupon, including having coupon indicia and separated from the rest of the first sheet by indicia or a line of weakness.

In a typical utilization of the form according to the invention, a plurality of forms are provided in a pad at, for example, a restaurant that offers pizza delivery. When the restaurant receives a phone order, one of the forms according to the invention is removed from the pad, and placed on the cardboard box containing the pizza. When the pizza is delivered to the purchaser, with the form attached, the form provides three functions. First, it is clearly visible (contrasting in color from the cardboard box) advertising for the restaurant. Secondly, it provides the removable label, with repositional adhesive, as well as instructions and/or illustrations for its use, which encourages the consumer to put the label on their phone hand set so that the number is readily available, thereby encouraging repeat business. Finally, by providing a coupon portion, the consumer is given incentive to retain the form, and again an encouragement for repeat business is provided.

According to another aspect of the present invention, a method of making business forms utilizing a first web of paper having a face and a back, and a plurality of labels with repositional adhesive, is provided, comprising the steps of: (a) Moving the first web of paper in a first direction. (b) As the first web of paper is moving in the first direction, applying the repositional adhesive labels to the face of the web in spaced relationship so that there is a regular substantial spacing between the labels in the first direction. (c) Forming the first web into sheets, each sheet having one repositional adhesive label on the face thereof. (d) Providing a pattern of repositional adhesive on the back of each sheet. And, (e) forming the sheets into a pad.

Step (a) is preferably practiced at a speed greater than 100 feet per minutes (e.g. about 128 feet per minute), and step (d) is also preferably practiced before step (b). Also, the labels are dimensioned to fit on a telephone hand set between the receiver and mouth piece, and there are the further steps of: (f) Printing indicia at a first location on the first web for each sheet illustrating the removable label on a hand set of a telephone; and (g) Printing a phone number on the label. Step (b) is practiced by placing a removable label adjacent each first location.

It is the primary object of the present invention to provide a simple business form which is easy to use and encourages repeat telephone orders. This and other objects of the invention will become clear from an inspection of the detailed description of the invention, and from the appended claims.

BRIEF DESCRIPTION OF THE DRAWINGS

FIG. 1 is a top plan view of an exemplary business form according to the invention, with one corner peeled back to illustrate the back of the form;

FIG. 2 is a top perspective view illustrating an exemplary use of the form of FIG. 1; and FIG. 3 is a schematic view of apparatus utilizable in producing a pad of forms in the practice of the method according to the invention.

DETAILED DESCRIPTION OF THE DRAWINGS

An exemplary business form according to the present invention is shown generally by reference numeral 10 in FIG. 1. The form includes a first paper sheet 11 having a face 12 and a back 13, and having a first area (size). As illustrated in FIG. 1 the sheet 11 preferably has a polygon (ideally rectangular) shape, and exemplary dimensions are about six inches by about four inches.

First indicia is disposed on the face 12 of the first sheet 11. This indicia may take many forms. For example it can include an advertising message indicia 14, and preferably includes indicia 15 illustrating a telephone hand set, as well as an illustration 16 of a label (which will be hereinafter described), as well as word indicia 17 providing instructions corresponding to the illustration 15, 16. Further indicia 18 may be provided, in the form of coupon redemption information, on a coupon portion 19 of the sheet 11. The coupon portion 19 is separated from the rest of the sheet 11 by the line 20 or the like. The line 20 may comprise indicia and/or a line of weakness (perforation).

The form 10 also preferably comprises a first pattern of repositional adhesive 22 disposed on the back 13 of the sheet 11. In the preferred exemplary form illustrated, the pattern 22 is a strip of repositional adhesive adjacent the top edge 23 of the sheet 11, and extending along its length (and remote from the coupon portion 19). The repositional adhesive forming the pattern 22 may comprise those adhesives used by Moore Business Forms, Inc. of Lake Forest, Ill. for its NOTE STIX ® products, or by 3M of Minneapolis, Minn. for its POST-IT ® products, or the like. The repositional adhesive 22 allows the sheet 11 to be placed on any substrate desired, and then readily removed from the substrate without leaving a significant mark or residue on the substrate, and then applied to a second substrate, etc.

The form 10 also comprises a second sheet 25 having a face 26 and a back 27 and an area much smaller than the area of the first sheet 11. For example, the second sheet 25 may be rectangular in configuration and have dimensions roughly about two inches by ¾ of an inch. The second sheet 25 is typically in the form of a paper label, comprising a paper sheet with a second pattern 28 of repositional adhesive disposed on the back 27 of the second sheet 25, the pattern 28 typically being a coating covering substantially the entire back 27 of the second sheet 25. The second sheet or label 25 also has second indicia disposed on its face 26, such as the indicia 29, 30. The indicia 29 is writing indicating products available from the organization utilizing forms 10, and preferably the second indicia includes a phone number 30 of the organization issuing the form 10. The second sheet or label 25 is placed on the first sheet 11 at a first location 32 thereof, which is adjacent the indicia 15-17 indicating how the second sheet or label 25 is to be utilized.

A typical manner of utilization of the form 10 according to the invention is illustrated in FIG. 2. In the embodiment illustrated, the form 10 is issued by a restaurant offering pizza delivery service. When the restaurant receives a phone order for a pizza, once the pizza is packaged a form 10 is placed on the top 35 of the cardboard box 36 (see FIG. 2) containing the pizza. The strip of repositional adhesive 22 holds the form 10 securely in place on the box top 35, yet may be readily removed by the consumer. The form 10 has a clear color contrast with the box top 35.

When the consumer receives the box 36, the consumer see the advertising message 14, the label 25, and the indicia 15 through 17 suggesting a use for the label 25, and the coupon portion 19. This indicia encourages the consumer to remove the label 25 from the face 12 of the first sheet 11, and place it between the mouth piece and ear piece of a telephone hand set, as provided by the illustration 15. In this way the reordering of pizza from the restaurant is encouraged since the product the restaurant offers is indicated by the indicia 29, and their phone number is indicated by the indicia 30, and it is provided at a convenient location for the consumer. The coupon 19 also encourages the consumer to reorder pizza from the restaurant, to retain the sheet 11 with the removable label 25 thereon, and when the consumer wants to utilize the coupon 19 he or she may merely cut along the line 20, or if the line 20 is a line of weakness, to detach the coupon portion 19 at that line 20.

While the invention has been described with respect to a pizza delivery restaurant, it is to be understood that the business form 10 according to the invention has extraordinarily wide applicability, in fact to almost any retail establishment. For example a delivery service may instruct its messengers to carry a pad of forms 10 with them, and when they pick up a package at one location to place a form 10 on the package when it is delivered to the next location. The form 10 in such a circumstance indicates who the package was delivered by, provides an advertising message to encourage the recipient to utilize this delivery service, provides the label 25 which may be placed on a telephone hand set or other surface to encourage calling the messenger service for the next delivery, and may include a coupon portion 19 for a discount on the next delivery requested. Alternatively, the forms 10 may be used by any retail establishment and applied by a cashier directly to the package of a consumer, particularly for retail stores that rely upon phone orders or on providing information over the phone as a significant part of their business (e.g. pharmacies, dry cleaners, etc.).

FIG. 3 schematically illustrates equipment that may be utilized to produce the forms 10 according to the method of the present invention. The apparatus includes a roll 40 of paper web 41 which is to be used to make the labels 25, and which may include a printer 42 for imprinting indicia (including the phone number 30) on the web 41, an adhesive coater 43 for applying the repositional adhesive 28 coating to the back of the web 41, and die cut apparatus 44 or the like for forming the web 41 into labels. The labels are delivered to one or more conventional labellers 45, such as the "Comet" 155 HPS labeller manufactured by Tols.

According to the method of the invention, a first web 48 of paper which will ultimately comprise the paper sheets 11 is provided in roll form 46, the web 47 moving in a first direction A by conventional web moving apparatus (such as rollers). The web 47 moves in the direction A at average press speed, e.g. over 100 feet per minute (such as approximately 128 feet per minute).

Repositional adhesive may be applied to the web 47 at any desired point in processing. For the purposes of illustration only, the repositional adhesive strip or strips 22 are applied to the web 47 as it is moving by the conventional adhesive coater 48. The indicia 14 through 18 is printed on the web 47 by a conventional printer 45, and a label 25 is applied to the moving web 47 (to a first location 32 thereof) by the conventional labeller 45. Ultimately, the web 47 is cut into sheets by the conventional sheeter 50, to provide the individual forms 10. The forms 10 may be constructed into a pad 52 in a conventional manner, with the top edges 23 (having the adhesive strip 22 adjacent thereto) aligned at the top of the pad 52. The individual forms 10 are readily removed from the pad 52 for use.

It will thus be seen that according to the present invention a business form, and a method of production thereof, have been provided that are particularly advantageous. The business form according to the present invention is simple in construction and easy to use, yet provides advertising, and a method of communicating the advertising, that maximize the probability of repeat phone orders for a retail establishment or the like. While the invention has been herein shown and described in what is presently conceived to be the most practical and preferred embodiment thereof, it will be apparent to those of ordinary skill in the art that many modifications may be made thereof within the scope of the invention, which scope is to be accorded broadest interpretation of the appended claims so as to encompass all equivalent structures and processes.

What is claimed is:

1. A business form comprising:

a first paper sheet having a face and a back;

first indicia disposed on the face of the first paper sheet;

a first pattern of repositional adhesive disposed on the back of the first paper sheet;

a second sheet having a face and a back, said second sheet much smaller than said first sheet;

second indicia disposed on the face of the second sheet;

a second pattern of repositional adhesive disposed on the back of the second sheet; and the second sheet back readily removably attached to the face of the first sheet by the second pattern of repositional adhesive, and positioned on the first sheet so that the first indicia is visible.

2. A business form as recited in claim 1 wherein the second pattern is a coating covering substantially the entire back of the second sheet.

3. A business form as recited in claim 2 wherein the second sheet is substantially rectangular and has dimensions roughly about two inches by ¾ of an inch.

4. A business form as recited in claim 3 wherein the first sheet is substantially rectangular in configuration, and has dimensions of about six inches by about four inches.

5. A business form as recited in claim 3 wherein the second indicia includes a phone number.

6. A business form as recited in claim 5 wherein the first indicia includes indicia illustrating the use of the second sheet on a telephone handset, the handset-illustrating indicia disposed adjacent the second sheet.

7. A business form as recited in claim 6 wherein the first sheet includes a coupon portion, separated by indicia or a line of weakness from the rest of the first sheet, and wherein the first indicia further comprises coupon redemption information on the coupon portion.

8. A business form as recited in claim 7 wherein the first sheet has the shape of a polygon, with edges, and wherein the first pattern of adhesive comprises at least one strip of repositional adhesive disposed along or adjacent one edge of the first sheet, remote from the coupon portion.

9. A business form as recited in claim 1 wherein the second sheet is paper.

10. A business form as recited in claim 1 wherein the first sheet has the shape of a polygon, with edges, and wherein the first pattern of adhesive comprises a single strip of repositional adhesive disposed along or adjacent one edge of the first sheet.

11. A business form as recited in claim 1 wherein the first sheet is substantially rectangular in configuration, and has dimensions of about six inches by about four inches.

12. A business form comprising:

a first paper sheet having a face and a back;

first indicia disposed on the face of the first paper sheet;

a substantially rectangular second sheet having a face and a back and having dimensions of roughly about two inches by ¾ of an inch, said second sheet smaller than said first sheet;

second indicia, including a phone number disposed on the face of the second sheet;

a pattern of repositional adhesive disposed on the back of the second sheet so that the second sheet is readily removably attached to the face of the first sheet by the pattern of repositional adhesive, said first indicia visible on said first sheet; and the first indicia including indicia illustrating the use of the second sheet on a telephone handset, the handset-illustrating indicia disposed adjacent the second sheet.

13. A business form as recited in claim 12 wherein the first sheet includes a coupon portion, separated by indicia or a line of weakness from the rest of the first sheet, and wherein the first indicia further comprises coupon redemption information on the coupon portion.

14. A business form as recited in claim 12 wherein the first sheet is substantially rectangular in configuration, and has dimensions of about six inches by about four inches.

15. A business form as recited in claim 12 wherein the second pattern is a coating covering substantially the entire back of the second sheet.

16. A combination of a business form and a cardboard box comprising:

a cardboard box;

a business form comprising: a first paper sheet having a face and a back; first indicia disposed on the face of the first paper sheet; a substantially rectangular second sheet having a face and a back and having dimensions of roughly about two inches by ¾ of an inch, said second sheet smaller than said first sheet; second indicia, including a phone number disposed on the face of the second sheet; a pattern of repositional adhesive disposed on the back of the second sheet so that the second sheet is readily removably attached to the face of the first sheet by the pattern of repositional adhesive, said first indicia visible on said first sheet; the first indicia including indicia illustrating the use of the second sheet on a telephone handset, the handset-illustrating indicia disposed adjacent the second sheet; and means attaching the first sheet to the cardboard.

17. A business form as recited in claim 16 wherein the first sheet is substantially rectangular in configuration, and has dimensions of about six inches by about four inches.

18. A business form as recited in claim 17 wherein the second pattern is a coating covering substantially the entire back of the second sheet.

* * * * *